United States Patent [19]

Berenter

[11] Patent Number: 4,748,821

[45] Date of Patent: Jun. 7, 1988

[54] METHOD AND APPARATUS FOR DISPENSING CONDENSATE

[76] Inventor: Allen Berenter, 840 Ocean Dr., Juno Beach, Fla. 33408

[21] Appl. No.: 105,516

[22] Filed: Oct. 1, 1987

Related U.S. Application Data

[63] Continuation of Ser. No. 919,656, Oct. 16, 1986, abandoned.

[51] Int. Cl.[4] ..... F25D 21/14

[52] U.S. Cl. ..... 62/188; 62/280; 62/289

[58] Field of Search ..... 62/188, 280, 289, 290, 62/291

[56] References Cited

U.S. PATENT DOCUMENTS

| | | | |
|---|---|---|---|
| 1,012,494 | 12/1911 | Wilson | 261/104 |
| 1,729,119 | 9/1929 | Odean | 261/104 |
| 1,757,856 | 5/1930 | Drubba | 261/104 |
| 2,240,906 | 5/1941 | Harold | 46/119 |
| 2,638,756 | 5/1953 | Borgerd | 62/280 |
| 2,688,235 | 9/1954 | Schwenker | 62/103 |
| 2,723,540 | 11/1955 | Derr | 62/140 |
| 2,839,279 | 6/1958 | Harris | 261/104 |
| 3,050,957 | 8/1962 | Robbie | 62/285 |
| 3,058,318 | 10/1962 | Polovitch | 62/289 |
| 3,196,632 | 7/1965 | Buffington | 62/281 |
| 3,276,754 | 10/1966 | Skerritt | 261/104 |
| 3,280,580 | 10/1966 | Costantini et al. | 62/275 |
| 3,358,467 | 12/1967 | Hickox et al. | 62/128 |
| 3,373,578 | 3/1968 | Feeney et al. | 62/189 |
| 3,405,919 | 10/1968 | Fisher et al. | 261/64 |
| 3,412,571 | 11/1968 | Bolynn | 62/188 |
| 3,441,256 | 4/1969 | Worsfold | 261/64 |
| 3,451,226 | 6/1969 | Shriver | 62/275 |
| 3,474,598 | 10/1969 | Keuls | 55/234 |
| 3,596,475 | 8/1971 | Berger | 62/285 |
| 3,673,770 | 7/1972 | Novak | 55/234 |
| 3,759,059 | 9/1973 | Kenyon | 62/246 |
| 3,760,601 | 9/1973 | Bunten | 62/280 X |
| 3,868,830 | 3/1975 | Fletcher et al. | 62/290 |
| 3,910,061 | 10/1975 | Irwin | 62/290 |
| 3,923,098 | 12/1975 | Ares | 165/111 |
| 4,136,529 | 1/1979 | McCarty | 62/305 X |
| 4,513,586 | 4/1985 | Jennings et al. | 23/12 |
| 4,562,016 | 12/1985 | Colliver | 3/4 |

*Primary Examiner*—Harry B. Tanner

*Attorney, Agent, or Firm*—Ronald P. Kananen

[57] ABSTRACT

A method and apparatus for atomizing and dispersing collected condensate in an air conditioning system to discharge mist-like droplets to the atmosphere. The improvement includes a pump and a nozzle provided as part of the air conditioning system in cooperation with a condensate collector, or as a retrofit for existing installations.

11 Claims, 2 Drawing Sheets

METHOD AND APPARATUS FOR DISPENSING CONDENSATE

This application is a continuation of application Ser. No. 919,656, filed 10/16/86, abandoned.

BACKGROUND OF THE INVENTION

This invention relates to an improved method and apparatus for dispersing condensate collected in a central air conditioning unit. More particularly, this invention relates to a method and apparatus for atomizing collected liquid condensate in a central air conditioning unit or convector unit and dispersing the atomized condensate outside of the conditioned air space. Still more particularly, this invention relates to an atomization device, provided as a part of an air conditioning unit or easily retrofitted to an existing unit, having a pump and nozzle arrangement for cooperating with the unit to atomize and disperse collected condensate from the air conditioning unit to a space outside of the unit, optionally under the control of a liquid level sensor.

Various types of central air conditioning systems are known for conditioning an interior space to improve the comfort level of the inhabitant. Such air conditioning units are available in many forms, such as window-mounted air conditioners, units mounted through the wall of a dwelling or building, forced-air convector units, or a centrally located air conditioning unit with ducting arrangements for distributing conditioned air throughout the premises. As is well known in the art, such units generally include an evaporator, a fan, a condenser, and a refrigerant system with appropriate valving in order to condition treated air moved past the evaporator and the condenser.

In such centralized air conditioning systems, the evaporator coil is customarily mounted in a cabinet which contains a blower for moving air through the evaporator and into the area to be cooled. Such units typically include a condensate collector for collecting condensate formed on the evaporator. In such systems, therefore, it is a continuous problem to collect and remove the condensate collected in such units to avoid contact between the condensate and the electrical components in the cabinet, and to avoid overflow of the condensate from the condensate collector which might cause damage to adjacent flooring and furnishings. Such a problem is particularly acute in apartment buildings having a number of forced-air convector units in the apartments.

Thus, it is a continuing problem in connection with such air conditioning systems to effectively remove the condensate from the condensate collector portions. A number of approaches have thus been tried to overcome this difficulty. For example, the condensate collector may be provided with an evaporative pad to assist in evaporating the collected condensate from the condensate collector to accelerate its dispersal. Another proposed solution has been to locate the condensate collector in a heated portion of the air conditioning system so that heat applied to the condensate collector assists in evaporation and dispersal of the condensate.

A more common solution is to provide a collection system for disposing of the condensate either on a unit-by-unit basis, such as from each convector, or for a plurality of units through a centralized condensate dispersal system. In an apartment building, for example, interior and exterior forced-air convector units when provided on an apartment-by-apartment basis may include a network of horizontal and vertical conduits interconnected to receive collected condensate from the individual units and to dispose of the collected condensate through the water waste system for the apartment. Such installations are costly and are generally most suitably provided during construction of the building. Such systems are not completely satisfactory, particularly in humid environments or during peak cooling seasons, because of the tendency of such systems to clog by the presence of deposits, dirt, and the like. Such clogging generally occurs in such horizontal runs of conduit, making it desirable to eliminate or reduce such runs. When the disposal system becomes clogged, the condensate tends to overflow from a condensate collector creating a potential safety hazard and a potential for damage to the surroundings.

Moreover, in older situations, such units of the through-the-wall variety have been accompanied by a condensate conduit connected from the condensate collector to the outside of the unit. Such conduits may exit the dwelling on a unit-by-unit basis and have generally proved satisfactory in providing an outlet for collected condensate. Such a solution is, however, unsatisfactory in the sense that the aesthetic look of a building is marred by the presence of a plurality of conduits extending from the building face and by the tendency of such conduits to agglomerate and coalesce the condensate resulting in noticeable drippings on the face of the building and potentially on passersby and on objects below.

Accordingly, it is a continuing problem in air conditioning systems, particularly for apartment buildings, to attend to disposal of collected condensate and to eliminate or reduce the maintenance costs involved when condensate systems become plugged.

It is thus an overall object of this invention to provide an improved method and apparatus for dispersing collected condensate from a central air conditioning unit.

It is another object of this invention to provide a method and apparatus for atomizing collected condensate for inoffensive discharge to the atmosphere.

It is another object of this invention to provide a pump and nozzle arrangement in connection with the central air conditioning unit for atomizing collected condensate for discharge to an exterior space from the unit.

It is an additional object of this invention to provide a condensate atomization unit which is readily adapted for connection to an existing central air conditioning unit for atomizing and discharging condensate from the condensate collector of the unit.

It is an additional object of this invention to provide a fluid level sensor for controlling the operation of the condensate collector as a function of the fluid level in the condensate collector.

These and other objects of this invention will become apparent from the detailed written description of the invention which follows, taken in conjunction with the accompanying drawings.

BRIEF SUMMARY OF THE INVENTION

Directed to achieving the foregoing objects, and overcoming the problems of the prior art, means are provided for atomizing and dispersing condensate in a central air conditioning unit collected in a condensate collector of the unit. In a preferred embodiment, the condensate atomizer comprises a pump having an inlet in fluid communication with a condensate collector and having its outlet connected to a nozzle for atomizing the condensate for discharge into the atmosphere. In an alternative embodiment, the pump is connected upstream of the condensate source to thus pressurize the condensate source upstream of the nozzle. In an alternative embodiment, a fluid sensor is provided for the condensate collector to sense the level of fluid in the collector for actuating the pump at predetermined fluid levels, thus to eliminate constant operation of the pump in the absence of collected condensate.

The condensate atomizer according to the invention may be provided as a part of the original equipment manufacture of the air conditioning unit, or as a retrofit kit for converting existing central air conditioning equipment to utilize the features of the invention. The invention is useful in connection with room air conditioners of the through-the-wall variety or the window-mounted variety, or in centralized air conditioning equipment having a plurality of air conditioning units connected to a common collector system. It is a particular advantage of the invention to eliminate or minimize horizontal runs, thus minimizing the tendency of the condensate to deposit salts and thus clog the system, while assuring a positive yet inoffensive discharge of atomized condensate to the atmosphere.

These and other features of the invention will become apparent from the written description of the invention which follows.

DETAILED DESCRIPTION OF THE PREFERRED EMBODIMENTS

Figure 1:
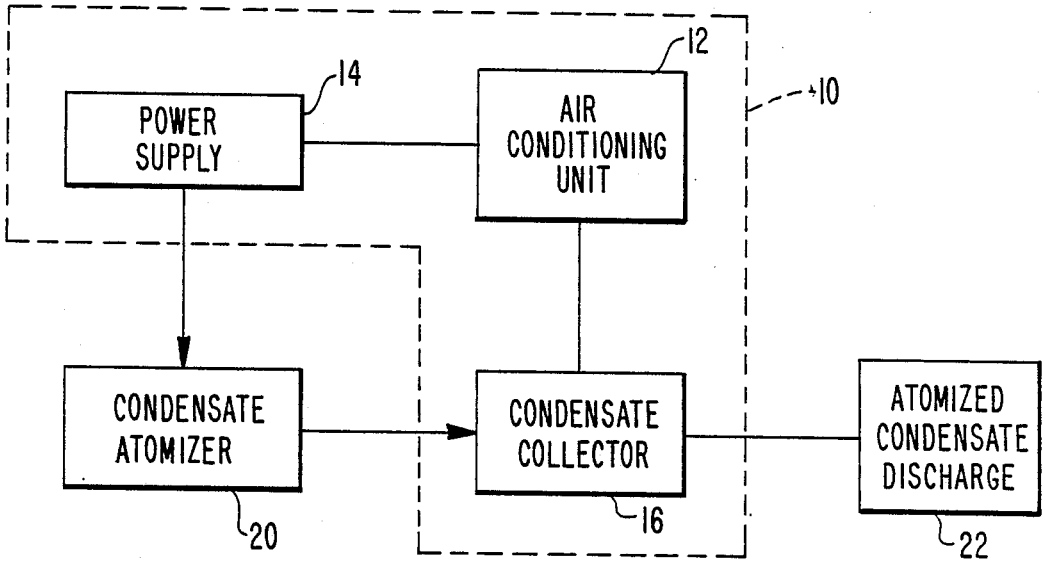
FIG. 1 is a functional block diagram of a central air conditioning system to which a condensate atomizer and discharge means according to the invention are applicable.

In FIG. 1, a central air conditioning system is shown in phantom outline and designated generally by the reference numeral 10. The system 10 includes an air conditioning unit 12 connected to a power supply 14 and further includes a condensate collector 16, such as a drip pan. Typically, such air conditioning systems include, as a part of the air conditioning unit 12, an evaporator, a condenser, a cooling coil, fans, and valves, cooperating with conduits to condition air in a conditioned space relative to an outside space. Such units take a variety of forms, including window-mounted air conditioning units, through-the-wall mounted air conditioning units, or centralized air conditioning units for providing conditioned air through ducts to a plurality of conditioned spaces, as is well known in the art.

Figure 6:
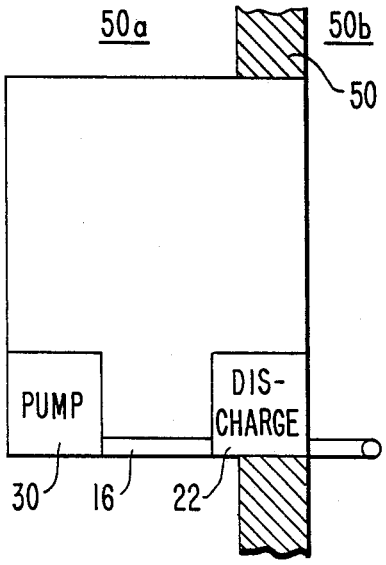
FIG. 6 shows the installation of the pump and nozzle according to the invention with a discharge pipe in a through-the-wall mounted air conditioning unit.
Figure 7:
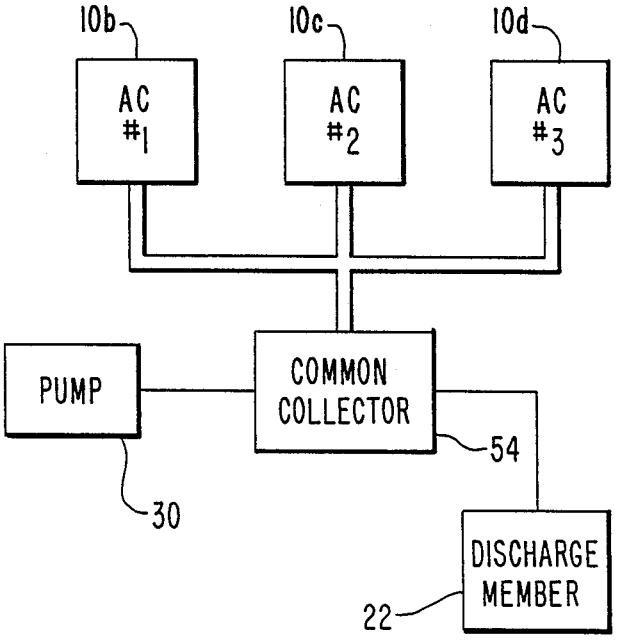
FIG. 7 shows a functional block diagram of a plurality of air conditioning units connected to a common collector, to which the invention is also applicable.

Typically, such air conditioning systems 10 include a condensate collector 16 for collecting condensate accumulating in the air conditioning unit 12 for discharge from the conditioned space to the outside or to a common collector for a plurality of such units, as is shown diagrammatically in FIGS. 6 and 7.

The improvement according to the invention includes a condensate atomizer 20 connected to the power supply 14 for cooperating with the air conditioning system 10, and in particular with the condensate collector 16 for atomizing the collected condensate and discharging the condensate from an atomized condensate discharge member 22.

Such a system is advantageous in controllably dispersing collected condensate away from the unit by atomizing collected condensate to a sufficiently fine mist or plurality of droplets so as to be inoffensive and unnoticeable, thus reducing or eliminating agglomeration or coalescense of such particles on the outside of the unit, or on the outside of a building. Use of the improvement according to the invention, therefore, eliminates dripping of collected condensate, reducing an opportunity for overflow and damage to surroundings.

Figure 2:
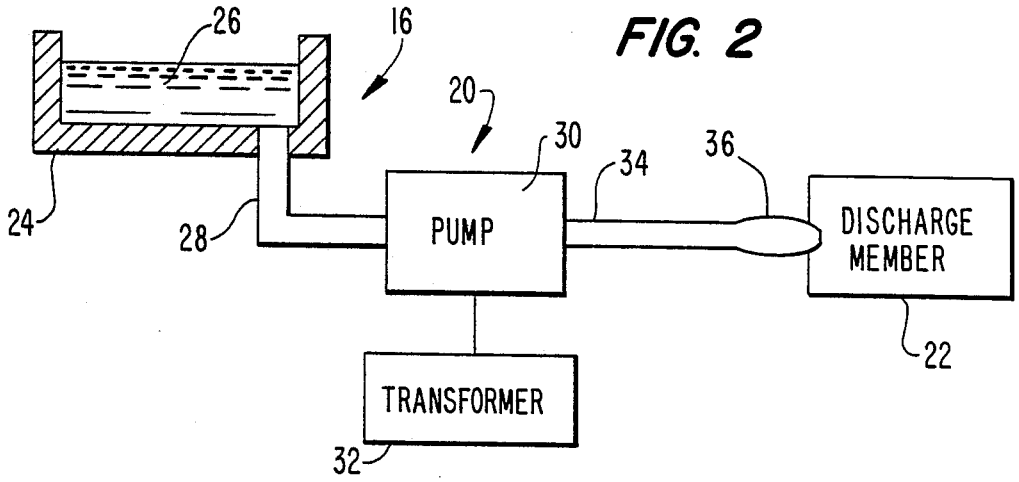
FIG. 2 is a functional block diagram of a first preferred embodiment of the invention wherein a pump is located downstream from a condensate collector.

FIG. 2 shows a functional block diagram of the basic components of the invention wherein the condensate collector 16 is shown in the form of a drip pan 24 which is typical of most air conditioning units 10. The condensate collector 16 includes a drip pan 24 having collected condensate 26 therein and an outlet conduit 28 connected to the drip pan 24. The condensate atomizer 20 includes a pump 30 connected directly to a power source 14, or through a transformer 32 for transforming line voltage to a low voltage for actuating a low voltage pump. The inlet of the pump 30 is connected to the conduit 28 and its outlet 34 is connected to a suitable nozzle 36 for atomizing the condensate for discharge through the condensate discharge member 22. In its simplest form, the condensate discharge member 22 may be in the form of a conduit connected at the outlet of the nozzle, and in close proximity thereto, to the outside of the unit. The outside edge of the condensate discharge conduit may be aesthetically and cosmetically covered, to shield the open end of the conduit from view, but without affecting its mist disposal function.

Figure 4:
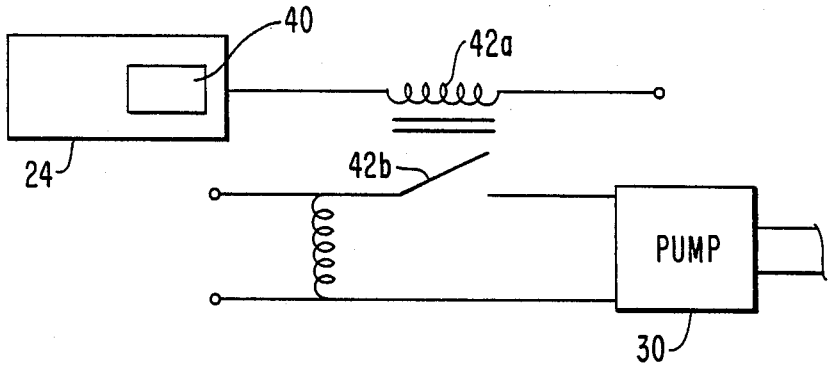
FIG. 4 is a truncated, electrical diagram showing a fluid level sensitive switch for intermittently actuating the pump as a function of the fluid level in the systems.

In the embodiment of FIG. 2, the pump may constantly run when the air conditioning unit is running, or when a selected fan in the air condtioning unit is running. In an alternative, as shown in FIG. 4, the drip pan 24 may include a fluid level sensor 40 for sensing a level of condensate fluid in the collector 16. When the fluid is above a predetermined upper level, the sensor 40 closes to actuate a relay coil **42*a* of a relay 42 to close a switch 42*b* to the pump 30. When the collected condensate 26 reaches a lowermost level as sensed by the switch 40, the relay coil 42*a* is opened, thus causing the contact 42*b* to open, ceasing operation of the pump. In this way, intermittent operation of the pump is achieved for efficiency reasons. The sensor 40** is commercially available and may be selected from a fluid sensitive switch, or a float/switch device.

Figure 3:
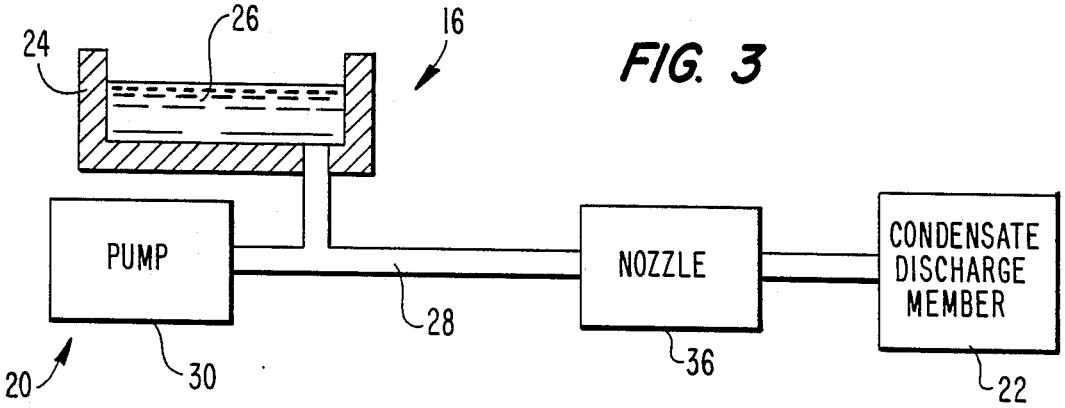
FIG. 3 is an alternative embodiment of the system of FIG. 2 in which the pump is upstream of the condensate collector.

In an alternative embodiment, as shown in FIG. 3, the pump 30 is located upstream of the conduit 28 from the drip pan 24 so as to avoid passing all of the collected condensate through the pump, while at the same time pressurizing the condensate in the nozzle 36 to atomize the condensate for discharge from the condensate discharge device 22. The positioning of the pump 30 as shown in FIG. 3 will also assist entraining the condensate 26 in the air, further enhancing its misting for discharge, as described above.

Figure 5A:
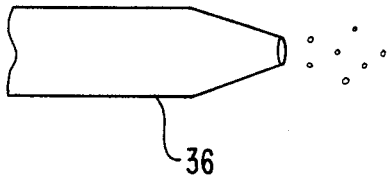
FIGS. 5A and 5B show representative nozzles for use with the invention.
Figure 5B:
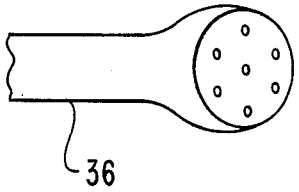

In its preferred embodiment, the nozzle 36 may take a variety of forms, having a single orifice as shown in FIG. 5*a* (such as a hose nozzle), or a plurality of orifices as shown in FIG. 5*b* (such as a shower head). The orifice, in combination with the inside diameter of the inlet conduit, the pressure provided by the pump on the condensate, and the parameters needed to produce droplets, or a fine mist, or an atomized discharge, are known to the art, and may be selected in accordance with a particular installation to achieve an inoffensive discharge.

It is a feature of this invention that the improvement may be provided in connection with the original equipment manufacutre, as shown in FIG. 6, or as a retrofit as shown in FIGS. 2 or 3, wherein a kit comprising a pump, a nozzle and necessary conduits and pipe fittings are provided as part of a maintenance conversion. For example, the conduit 28 may be cut, a tee inserted, the pump and nozzle connected, and an outlet conduit connected to the nozzle. In the unit of FIG. 6, a through-the-wall air conditioner is shown wherein the unit 10*a* is mounted in a wall 50 for conditioning the interior space 50*a* relative to the exterior space 50*b*. In such an embodiment, the atomized discharge member 22 takes the form of a conduit either connected directly to the unit 10*a* as shown in FIG. 5, or connected to an interior portion of the conduit having its outlet exiting on the outlet side 50*b* of the wall. In practice, such a conduit may be located in an opening drilled in the wall of the building, thus avoiding long horizontal runs for the condensate collector system.

FIG. 7 illustrates an embodiment wherein a plurality of air conditioners 10*b*, 10*c* and 10*d* are connected with a common collector 54 to which a pump 30 and discharge 22 are provided to achieve the objectives of the invention, as described above.

The invention may be embodied in other specific forms without departing from its spirit or esssential characteristics. The present embodiments are,. therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed:

1. For use in connection with an air conditioning system for conditioning air in a conditioned space relative to an outside space and having a condensate collector for collecting condensate produced by an air conditioner in said system, the improvement comprising:

means for atomizing the collected condensate from the condensate collector, said atomizing means comprising an atomizing nozzle, conduit means for conducting the condensate from the condensate collector to said atomizing nozzle, and pump means connected with said conduit means for conducting the condensate through said atomizing nozzle, wherein said atomizing nozzle discharges to a condensate discharge member in direct communication with said outside space and out of communication with the air conditioning system.

2. The improvement as set forth in claim 1, wherein said atomizing nozzle has at least one orifice sized to produce mist-like droplets of said condensate.

3. The improvement as set forth in claim 2, wherein said pump means comprises a pump having an inlet in fluid communication with said condensate collector and an outlet in fluid communication with said atomizing nozzle.

4. The improvement as set forth in claim 2, wherein said pump means comprises a pump having an outlet connected to said conduit means for pressurizing condensate in said conduit means.

5. The improvement as set forth in claim 2, wherein said atomized condensate discharge member comprises a conduit connected to an outlet of said nozzle, said conduit having an end distal to said nozzle terminating in said outside space.

6. The improvement as set forth in claim 5, wherein said air conditioning unit is a through-the-wall air conditioner, and said conduit is a pipe.

7. The improvement as set forth in claim 1, further including a fluid level sensor for sensing a predetermined level of fluid in said condensate collector to actuate said pump means when the level of fluid in said condensate collector is at said predetermined level and to cease operation of said pump means when the level of fluid in said condensate collector is a level lower than said predetermined level.

8. The improvement as set forth in claim 1 wherein said air conditioning system comprises a plurality of air conditioning units having commonly-connected condensate collectors in fluid circuit with a common collector, said pump means being connected to said common collector.

9. A method for discharging condensate collected in a condensate collector in an air conditioning system for conditioning air in a conditioned space relative to an outside space, comprising the steps of:

conducting the collected condensate from the condensate collector to an atomizing nozzle;

atomizing the conducted condensate by discharging it from the atomizing nozzle; and discharging the atomized condensate from the nozzle to a space in direct communication with the outside space and out of communication with the air conditioning system.

10. The method as set forth in claim 9, further including the steps of:

sensing a predetermined level of fluid in the condensate collector; and actuating pump means to force the condensate through the atomizing nozzle when the level of fluid in the condensate collector reaches the predetermined level.

11. A method of retrofitting an air conditioning system for conditioning air in a conditioned space relative to an outside space, wherein the air conditioning system includes a condensate collector for collecting condensate produced by the air conditioning system, comprising the steps of:

providing means for conducting the collected condensate from the condensate collector;

providing an atomizing nozzle in fluid communication with said conduit means;

connecting to the conducting means pump means for forcing the collected condensate through the atomizing nozzle;

providing a condensate discharge member free of flow restrictions and terminating in the outside space; and arranging the atomizing nozzle to discharge directly into the discharge condensate member.

* * * * *